US005526757A

United States Patent [19]

Yang

[11] Patent Number: 5,526,757

[45] Date of Patent: Jun. 18, 1996

[54] CARCASS CREMATOR

[76] Inventor: Johnny Yang, 56, Min Sheng Street, Fengyuan, Taichung, Taiwan, Taiwan

[21] Appl. No.: 425,422

[22] Filed: Apr. 21, 1995

[51] Int. Cl.[6] ..... F23G 1/00

[52] U.S. Cl. ..... 110/194; 110/248

[58] Field of Search ..... 110/194, 243, 110/248, 259

[56] References Cited

U.S. PATENT DOCUMENTS 4,280,417 7/1981 Alexandersson ..... 110/248

5,052,312 10/1991 Rackley et al. ..... 110/259

*Primary Examiner*—Noah P. Kamen

[57] ABSTRACT

A carcass cremator has an inner chamber which is defined by firebrick walls. At least two thirds of the inner chamber is buried underground. A tube is disposed at the center of the inner chamber. A metal bowl is disposed on the tube. A top cover covers the top portion of the inner chamber. A flame inlet is formed at the lower portion of the firebrick walls. A vortex space is formed in the inner chamber. The flames enter into the vortex space via the flame inlet.

3 Claims, 7 Drawing Sheets

CARCASS CREMATOR

BACKGROUND OF THIS INVENTION

This invention relates to a carcass cremator, and more particularly to a cremator for animal remains which can be burned quickly with strong flames.

Domestic animals and poultry are often dead because of fowl pest, septicemic plague, and other epidemical pestilence. The carcasses which are poured with oil are disposed on a large pan, and the carcasses are burned. If the carcasses are too large, they must be cut into small pieces before they are burned. However, the smell of the burning oil is stink and the smaze is very concentrated. It takes a long period of time in order to burn the carcasses completely. Therefore, it wastes oil and time in conventional carcass cremation.

SUMMARY OF THIS INVENTION

The main object of this invetion is to provide a carcass cremator which can concentrate strong flames to cremate the carcasses almost completely.

Another object of this invention is to provide a carcass cremator which can cremate the carcasses in an array.

A further object of this invention is to provide a carcass cremator which can cremate the carcasses quickly at very low cost.

DESCRIPTION OF THE PREFERRED EMBODIMENT

The features of this invention are described as follows. An inner chamber is defined by fireproof materials such as fireproof bricks, stones, clinkers and firebricks. The fireproof materials which become the walls of the inner chamber surround the inner chamber, and the inner chamber is thus formed. At least two thirds of the inner chamber is buried underground. A tube that supports the metal bowl is disposed approximately at the center of the inner chamber. A metal bowl is disposed on the tube. A top cover covers the top portion of the inner chamber. A flame inlet is formed at the lower portion of the fireproof wall. A vortex space or helix space is formed in the inner chamber in order to allow the strengthening and concentration of the flames.

A preferred embodiment of this invention is described in the following paragraphs.

Figure 1:
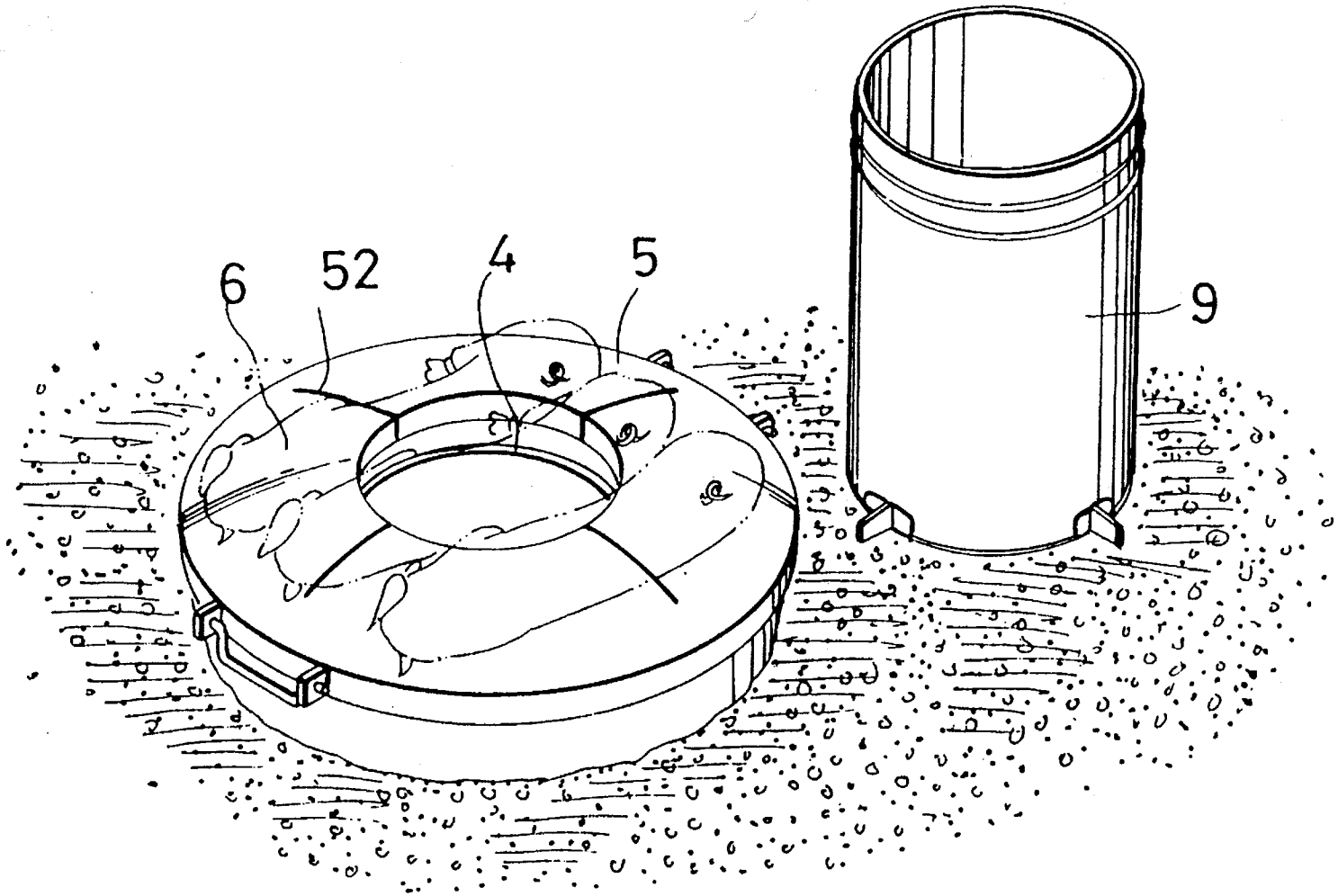
FIG. 1 shows a partially perspective view of a carcass cremator of a preferred embodiment in accordance with this invention.
Figure 2:
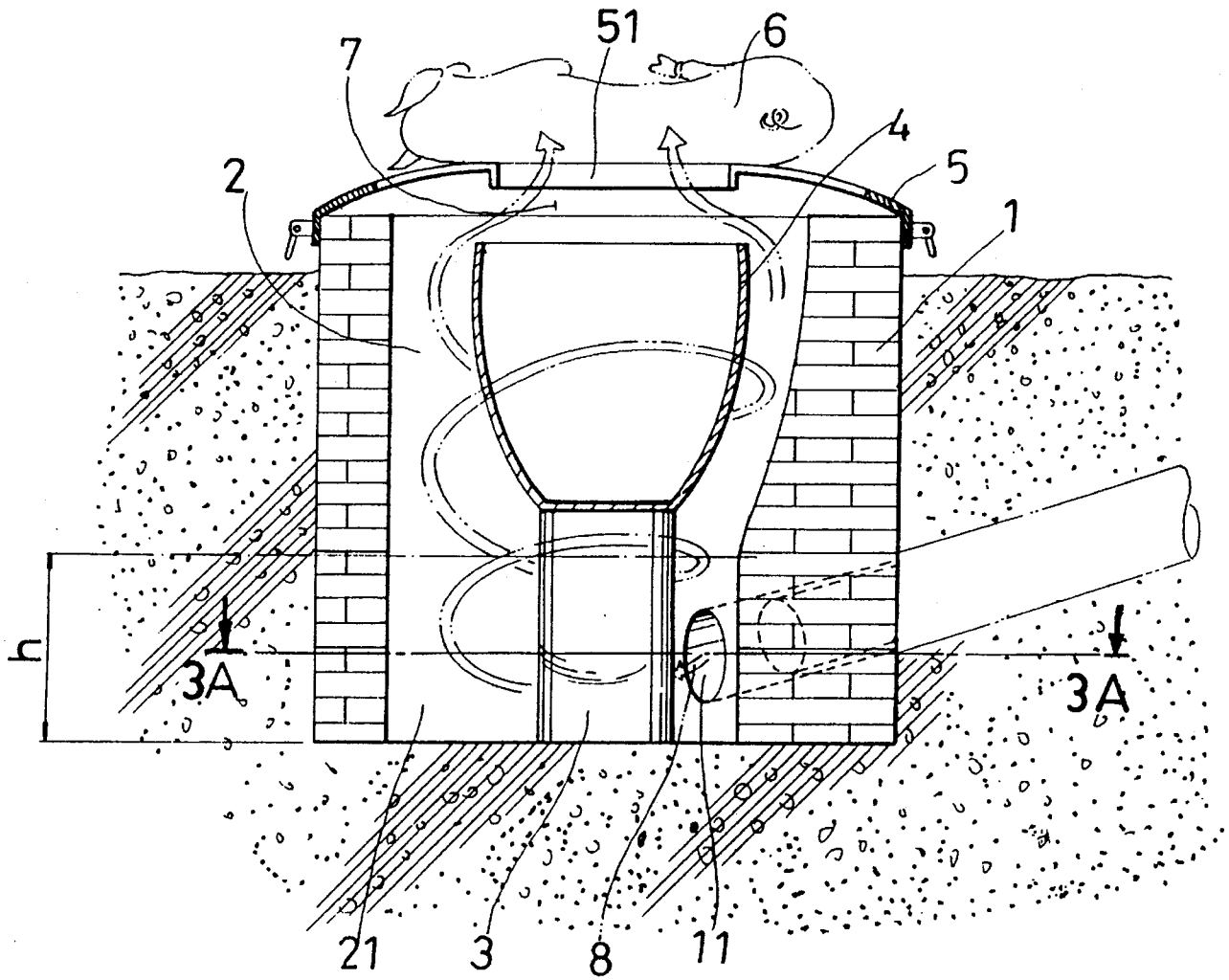
FIG. 2 shows a side and partially cross-sectional view of a carcass cremator of the preferred embodiment in this invention.
Figure 3:
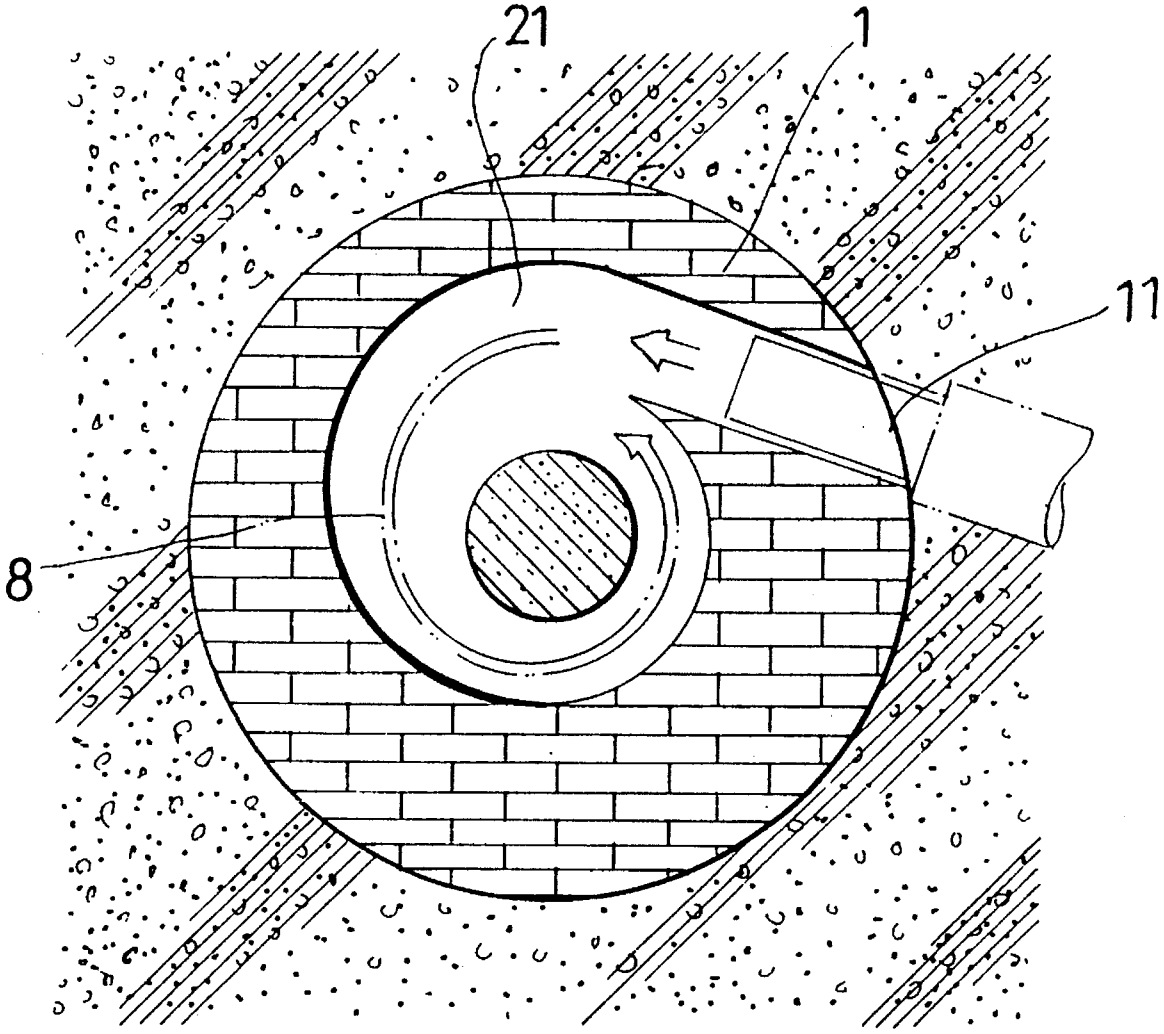
FIG. 3 is a cross-sectional view taken along the line A—A in FIG. 2.

Referring to FIGS. 1 to 3, a large cave which has predetermined depth underground is formed. The periphery of the large cave is paved by fireproof material such as firebricks 1 to form a fireproof wall. The fireproof wall forms an inner chamber 2 therein. Referring to FIG. 2, a flame inlet 11 is formed at the lower portion of the wall which is under the height(h) from the bottom of the wall. A vortex (or eddy) space 21 which flares gradually and upwardly along the wall is formed in the interior of the inner chamber 2. A tube 3 that supports a metal bowl 4 is disposed approximately at the center of the inner chamber 2. The top portion of the tube 3 is flat so that a metal bowl 4 can be disposed on the tube 3. A top cover 5 which has a central hole 51 is disposed on the top portion of the inner chamber 2. The central hole 51 has a diameter smaller than that of the top portion of the bowl 4. Therefore, spacing 7 is formed between the top cover 5 and the bowl 4 so that the flames can spread out. A plurality of gaps 52 are formed on the top portion of the top cover 5 to allow the expansion and contraction of the top cover 5.

Figure 4:
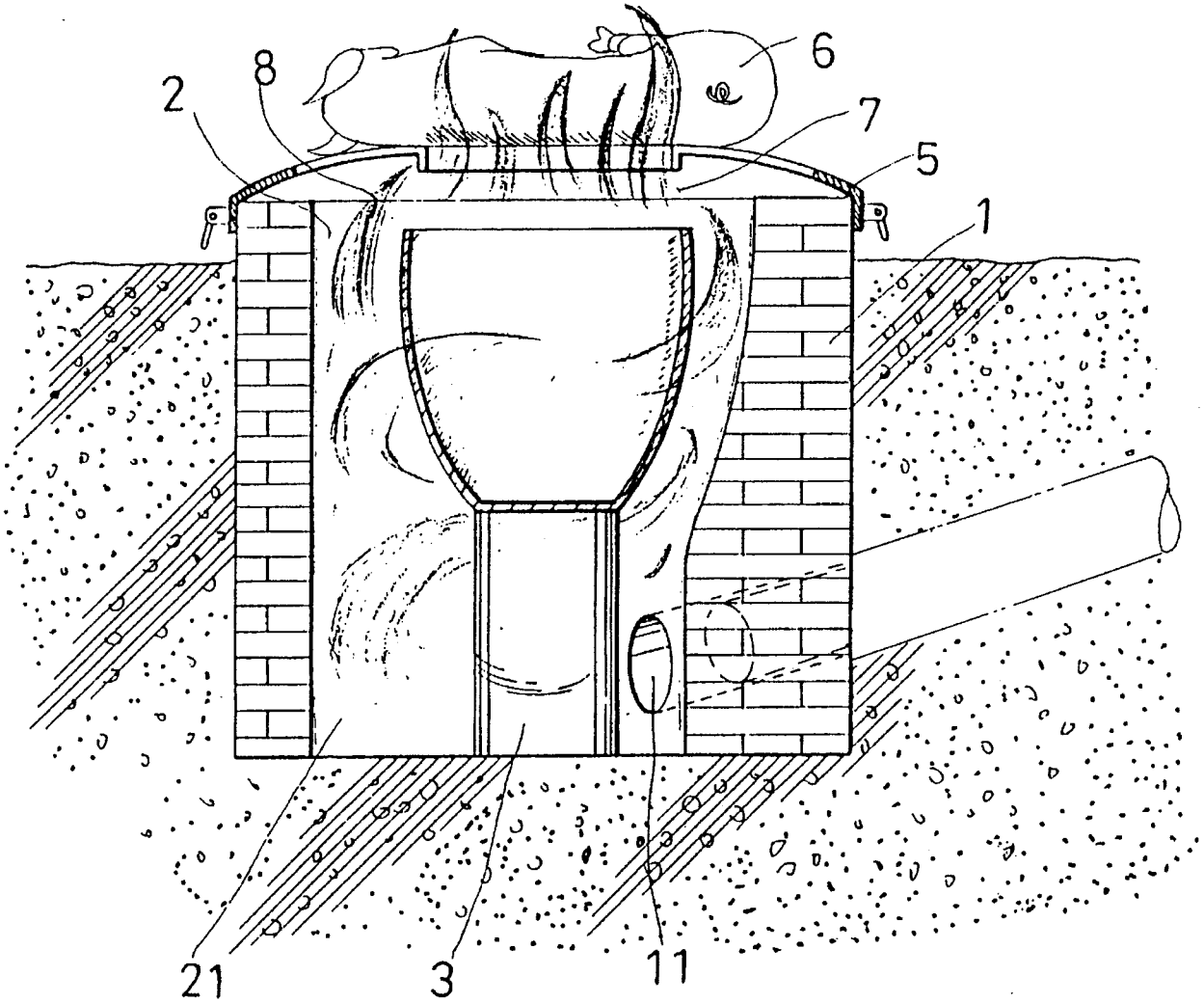
FIG. 4 is a side and partially cross-sectional view of a carcass cremator of the preferred embodiment for explaining the cremation of a carcass.
Figure 5:
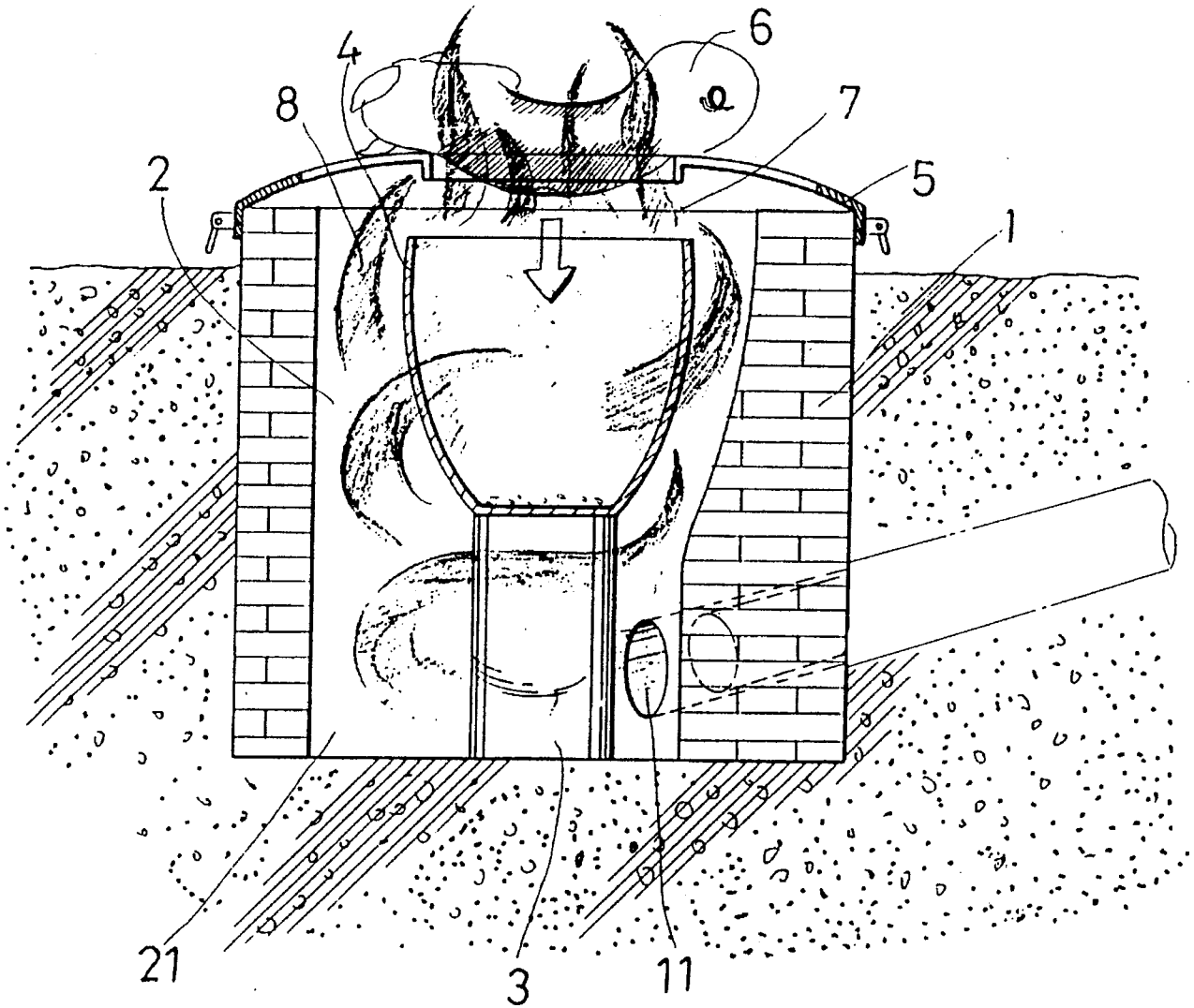
FIG. 5 is a schematic view of FIG. 4 showing the softening and descending of the middle portion of the carcass into the carcass cremator.
Figure 6:
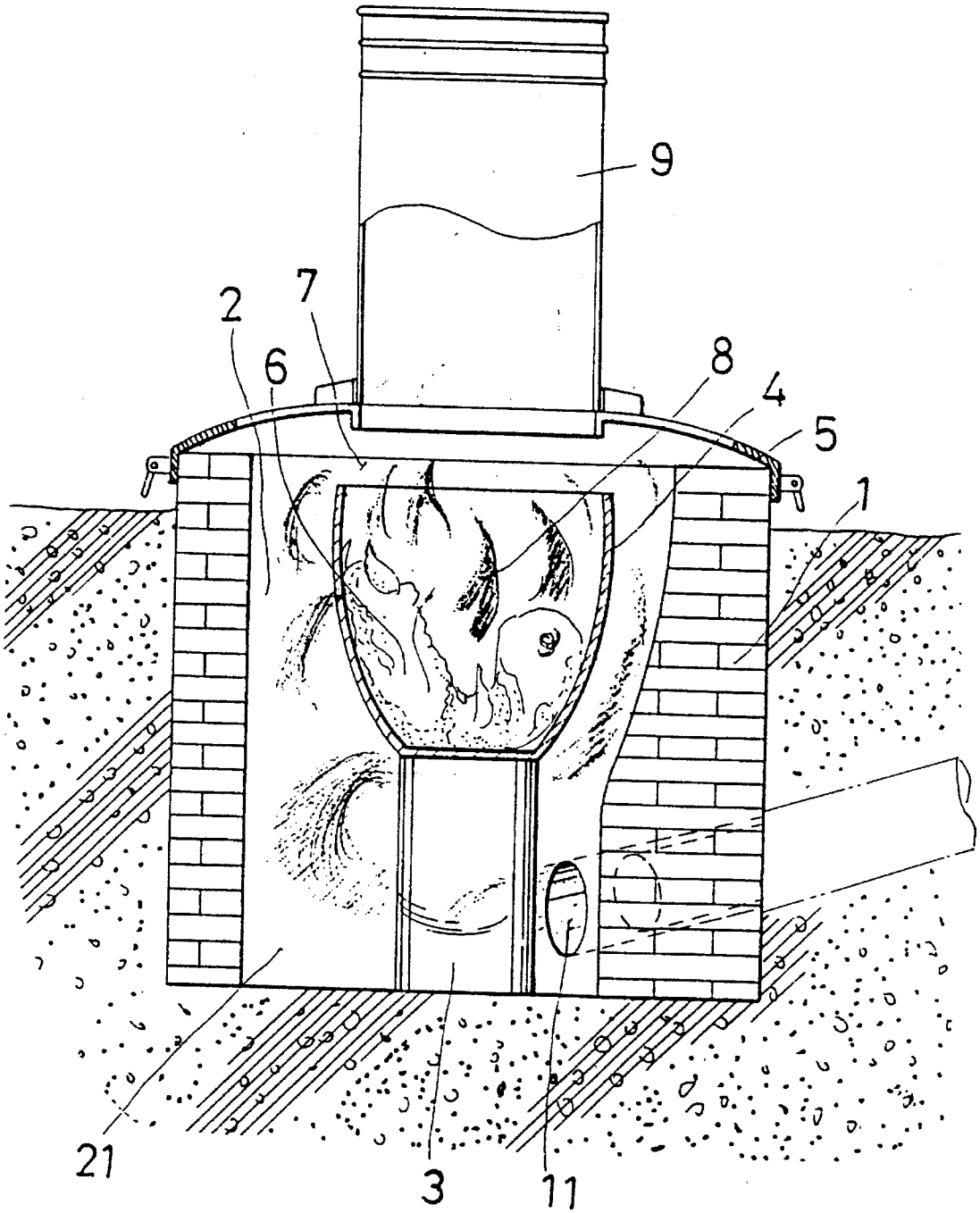
FIG. 6 shows a side and partially cross-sectional view of the cremation of a carcass while a metal barrel covering the top portion of the carcass cremator.
Figure 7:
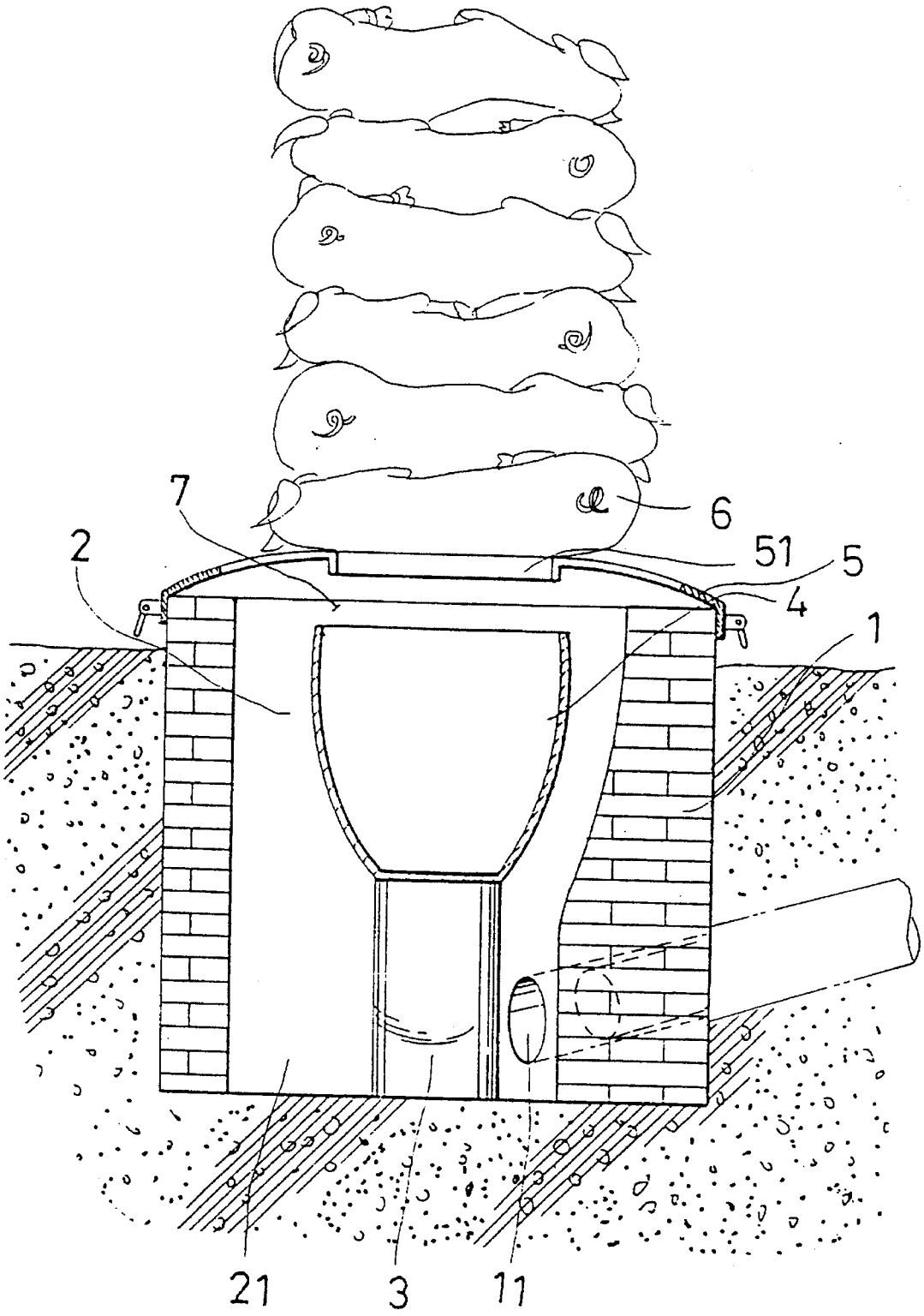
FIG. 7 shows a side and partially cross-sectional view of the cremation of the carcasses while an array of the carcasses arranged on the top portion of the carcass cremator for cremation.

Referring to FIGS. 2 and 3, a carcass 6 is placed on the top cover 5, and a combustion machine is disposed at the flame inlet 11 to ignite strong flames 8. The flames 8 spread upwardly along the vortex space 21 and spread outwardly along the spacing 7 so that the middle portion of the carcass 6 is burned by the rapid and strong flames 8. Referring to FIG. 4, the middle portion of the carcass 6 is burned by the flames 8. Referring to FIG. 5, the middle portion of the carcass 6 is softened and descended into the bowl 4 gradually. The bowl 4 burns the remains of the carcass 6 continuously with strong flames and high temperatures. Referring to FIG. 6, a hollow metal barrel 9 covers the central hole 51 of the top cover 5 to form a top chamber after the carcass 6 falls down to the bowl 4 so that the flames 8 can be concentrated in the inner chamber 2. Therefore, the carcass 6 is completely cremated. The ash can be easily removed from the bowl 4 after the carcass 6 is cremated completely. FIG. 7 shows an array of the carcasses 6 which are placed on the top cover 5 and are ready for cremation. It is very convenient to cremate an array of the carcasses with the assembly of this invention. Furthermore, the vortex space can concentrate and strengthen the flames. The strong and concentrated flames can cremate the carcasses very quickly at very low cost.

What is claimed is:

1. A carcass cremator comprising:

a cave having predetermined depth being formed underground;

fireproof material paved periphery of said cave to form a fireproof wall;

an inner chamber being defined by said fireproof wall;

a flame inlet being formed at a lower portion of said fireproof wall;

a vortex space flaring gradually and upwardly along said fireproof wall in an interior of said inner chamber;

a tube that supports a metal bowl being disposed approximately at a center of said inner chamber;

said metal bowl being disposed on a top of said tube;

a top cover having a central hole being disposed on a top portion of said inner chamber;

said central hole having a diameter smaller than a diameter of a top portion of said metal bowl;

spacing being formed between said top cover and said metal bowl; and a plurality of gaps being formed on said top cover.

2. A carcass cremator as claimed in claim 1, wherein said fireproof material is selected from the group consisting of bricks, stones, clinkers and firebricks.

3. A carcass cremator as claimed in claim 1, wherein a metal barrel is disposed on said top cover to form a top chamber.

* * * * *